US011083930B1

(12) United States Patent
Tipple et al.

(10) Patent No.: US 11,083,930 B1
(45) Date of Patent: Aug. 10, 2021

(54) PORTABLE ROWING FRAME

(71) Applicant: Whipr, Inc., Wilmington, DE (US)

(72) Inventors: Luke Tipple, Oceanside, CA (US); Tiziano Cousineau, Toronto (CA); David Riley, Markham (CA)

(73) Assignee: WHIPR, INC., Wilmington, DE (US)

( * ) Notice: Subject to any disclaimer, the term of this patent is extended or adjusted under 35 U.S.C. 154(b) by 0 days.

(21) Appl. No.: 17/191,513

(22) Filed: Mar. 3, 2021

Related U.S. Application Data

(63) Continuation-in-part of application No. 17/086,122, filed on Oct. 30, 2020, now abandoned.

(60) Provisional application No. 63/045,553, filed on Jun. 29, 2020.

(51) Int. Cl.
*A63B 22/00* (2006.01)
*A63B 21/00* (2006.01)

(52) U.S. Cl.
CPC ..... *A63B 22/0076* (2013.01); *A63B 21/4034* (2015.10); *A63B 22/0087* (2013.01); *A63B 2022/0079* (2013.01)

(58) Field of Classification Search
None
See application file for complete search history.

(56) References Cited

U.S. PATENT DOCUMENTS 4,421,307 A * 12/1983 Cunnington ..... A63B 21/018 482/120
4,674,741 A * 6/1987 Pasierb, Jr. ..... A63B 24/00 482/72
4,880,224 A * 11/1989 Jonas ..... A63B 21/153 482/72
4,940,227 A 7/1990 Coffey
5,013,033 A * 5/1991 Watterson ..... A63B 22/0076 482/127
5,707,322 A * 1/1998 Dreissigacker ..... A63B 21/227 482/72
5,916,069 A * 6/1999 Wang ..... A63B 21/153 482/72
6,328,677 B1 12/2001 Drapeau
6,371,892 B1 * 4/2002 Dreissigacker ..... A63B 21/227 482/72
6,749,546 B2 * 6/2004 Yang ..... A63B 21/153 482/116
8,771,151 B2 7/2014 Larsson
9,750,972 B1 * 9/2017 Liu ..... A63B 22/20
9,764,185 B2 * 9/2017 Lonergan ..... A63B 22/0076
9,764,186 B2 * 9/2017 Dalebout ..... A63B 22/0087
(Continued)

*Primary Examiner* — Joshua Lee

(57) ABSTRACT

A portable rowing frame that mounts a portable resistance device is presented. The rowing frame contains a front rowing beam, a rear rowing beam, a mounting beam, a rowing seat, at least one leg, and a pedal assembly. The front rowing beam and the rear rowing beam each contains a slider rail and a mounting channel. The front rowing beam contains a first mounting element. The slider rail and the mounting channel traverses from the front rowing beam to the rear rowing beam. The rear rowing beam is attached to the front rowing beam through a connection element. The first mounting element is positioned to the front rowing beam. The mounting beam is attached to the first mounting element. The rowing seat is attached to the slider rail. The legs are distributed about the mounting channel. The pedal assembly is connected to the front rowing beam.

10 Claims, 6 Drawing Sheets

(56) References Cited

U.S. PATENT DOCUMENTS

| | | | | |
|---|---|---|---|---|
| 9,808,698 | B2 | 11/2017 | White | |
| 10,376,730 | B2 | 8/2019 | Cei et al. | |
| 10,449,409 | B2 * | 10/2019 | Hamilton | A63B 21/012 |
| 10,610,725 | B2 * | 4/2020 | Schaefer | A63B 24/0075 |
| 10,639,520 | B2 * | 5/2020 | Hou | A63B 22/0087 |
| 10,682,546 | B2 * | 6/2020 | Dubin | A63B 21/153 |
| 2003/0216227 | A1 * | 11/2003 | Smith | A63B 22/0076 482/72 |
| 2008/0261782 | A1 * | 10/2008 | Campbell | A63B 22/0076 482/72 |
| 2016/0144223 | A1 * | 5/2016 | Dalebout | A63B 22/0076 482/72 |
| 2017/0043208 | A1 * | 2/2017 | Lonergan | A63B 22/0087 |
| 2018/0126216 | A1 * | 5/2018 | Hamilton | A63B 21/0088 |

* cited by examiner

PORTABLE ROWING FRAME

The current application is a continuation-in-part (CIP) application of a U.S. non-provisional application Ser. No. 17/086,122 filed on Oct. 30, 2020. The U.S. non-provisional application Ser. No. 17/086,122 claims a priority to a U.S. provisional application Ser. No. 63/045,553 filed on Jun. 29, 2020.

FIELD OF THE INVENTION

The present invention relates generally to a rowing exercise machines. More specifically, the present invention is a portable rowing frame configured to mount a portable resistance device such that it functions as a rowing exercise machine.

BACKGROUND OF THE INVENTION

Exercise machines are often bulky and heavy pieces of equipment that can make it difficult for active users to easily move around. More particularly, indoor rowing machines have a large frame in which a user can sit in to more comfortably perform exercises and to simulate the position assumed when rowing a physical boat. However, such a machine is not meant for moving to other positions or for travel. Many of these machines are also only capable of a single type of exercise, specifically a rowing motion which can leave a user wanting for a more diverse workout session.

An objective of the present invention is to create a portable rowing frame suited for mounting a portable resistance device such that the combination of the two makes a rowing exercise machine. The portable rowing frame is easily taken down and packed into a suitcase sized case. The portable rowing frame is easily deployed to any suitable location such that a user can perform rowing exercises.

SUMMARY OF THE INVENTION

The present invention is a rowing frame. The rowing frame comprises a front rowing beam, a rear rowing beam, a mounting beam, a rowing seat, at least one leg, and a pedal assembly. The front rowing beam and the rear rowing beam each comprises a slider rail and a mounting channel. The front rowing beam comprises a first mounting element. The slider rail traverses from the front rowing beam to the rear rowing beam. The mounting channel traverses from the front rowing beam to the rear rowing beam, opposite to the slider rail. The rear rowing beam is removably attached to the front rowing beam through a connection element. The first mounting element is positioned opposite to the rear rowing beam along the front rowing beam. The mounting beam is removably attached to the first mounting element, where the mounting beam is configured to mount a portable resistance device that facilitates a rowing machine handle. The rowing seat is slidably attached to the slider rail. At least one leg is distributed about the mounting channel. The pedal assembly is connected adjacent to the front rowing beam, opposite to the rear rowing beam.

DETAIL DESCRIPTIONS OF THE INVENTION

Figure 1:
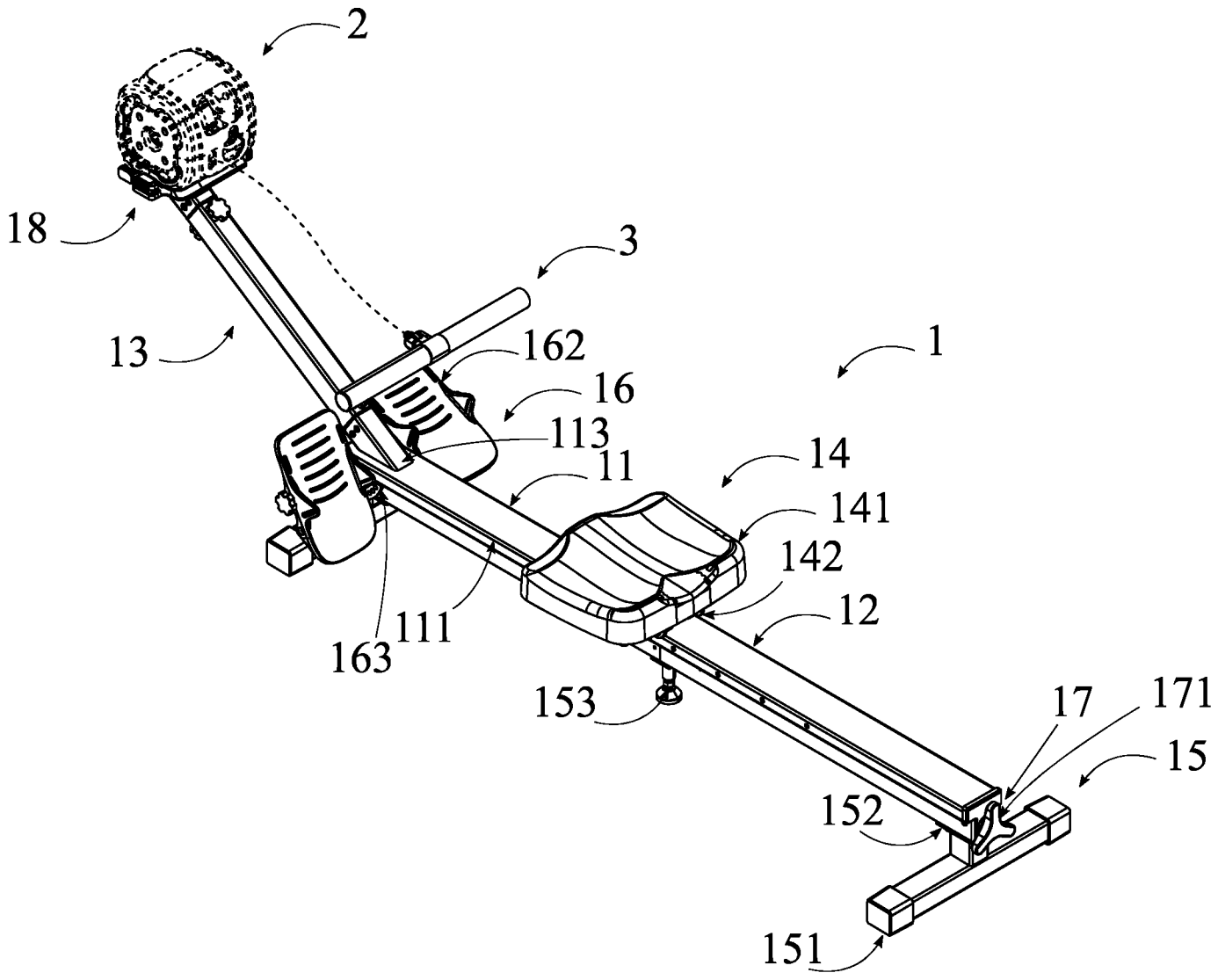
FIG. 1 is a top perspective view of the present invention.
Figure 2:
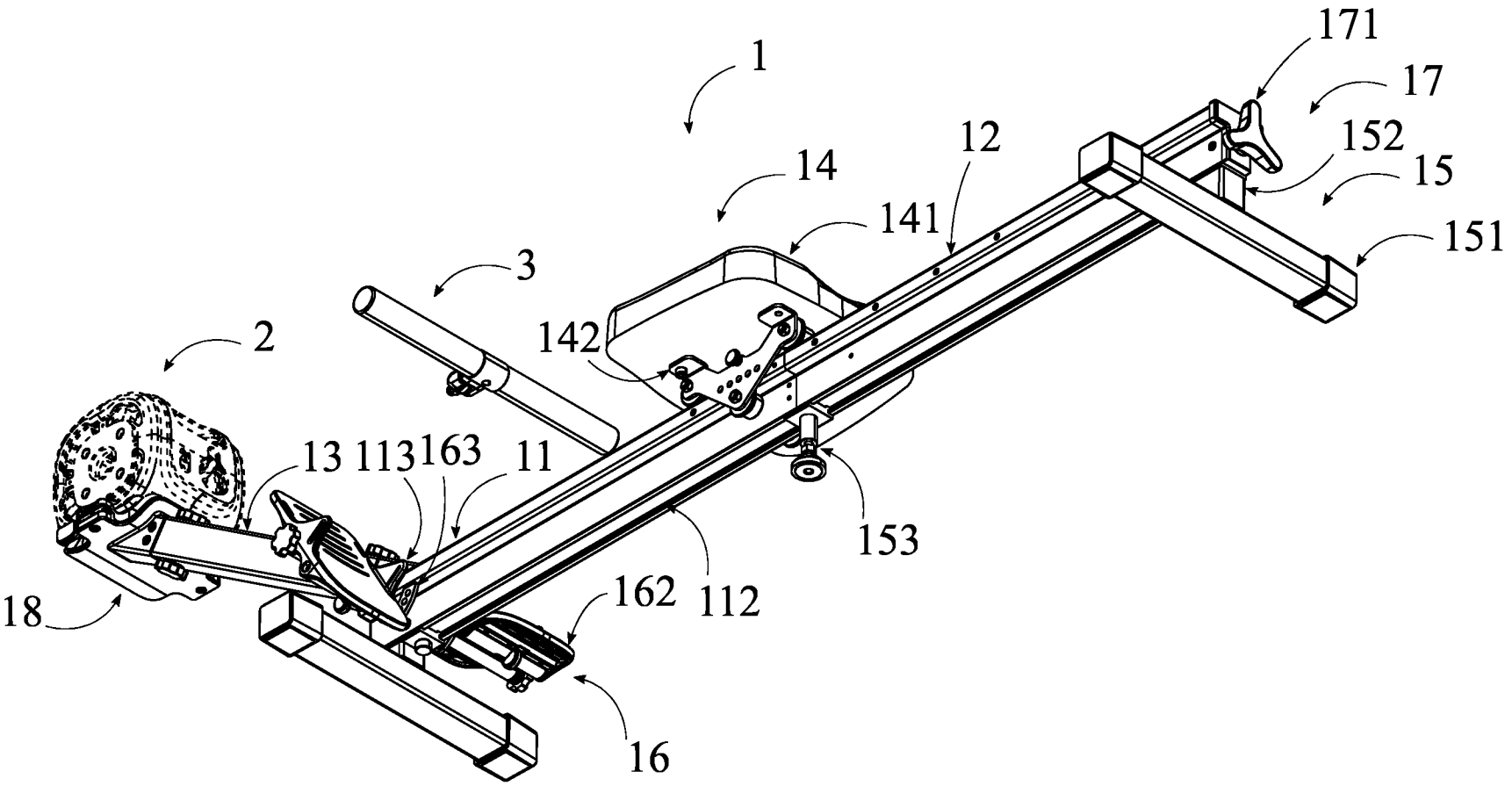
FIG. 2 is bottom perspective view of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIGS. 1-5, the present invention is a rowing frame 1. The rowing frame 1 comprises a front rowing beam 11, a rear rowing beam 12, a mounting beam 13, a rowing seat 14, at least one leg 15, and a pedal assembly 16. The front rowing beam 11 and the rear rowing beam 12 each comprises a slider rail 111 and a mounting channel 112. The front rowing beam 11 comprises a first mounting element 113. The slider rail 111 traverses from the front rowing beam 11 to the rear rowing beam 12. The mounting channel 112 traverses from the front rowing beam 11 to the rear rowing beam 12, opposite to the slider rail 111. The rear rowing beam 12 is removably attached to the front rowing beam 11 through a connection element 17. The first mounting element 113 is positioned opposite to the rear rowing beam 12 along the front rowing beam 11. The mounting beam 13 is removably attached to the first mounting element 113, where the mounting beam 13 is configured to mount a portable resistance device 2 that facilitates a rowing machine handle 3. The rowing seat 14 is slidably attached to the slider rail 111. At least one leg 15 is distributed about the mounting channel 112. The pedal assembly 16 is connected adjacent to the front rowing beam 11, opposite to the rear rowing beam 12. In the preferred embodiment of the present invention, rowing frame 1 is made out of a lightweight and durable material suitable for travel, such as, but not limited to aluminum, carbon fiber, fiberglass, polymer, or any other suitable material. In the preferred embodiment of the present invention, the first mounting element 113 of the front rowing beam 11 may take the form of any connection implement that facilitates quick assembly or disassembly of the front rowing beam 11 from the mounting beam 13. The first mounting element 113 may take the form of a bolt and block type fastener but may take the form of any other suitable fastening implement. In the preferred embodiment of the present invention, the at least one leg 15 may take the form of frame risers that stabilizes and supports the rowing frame 1 along a flat surface. In various embodiments, the at least one leg 15 may take the form of any other suitable frame stabilizer that secures the rowing frame 1 along any suitable surface.

The rowing frame 1 further comprises a mounting bracket 18, as shown in FIGS. 1-3 and 5-6. The mounting bracket 18 is removably attached adjacent to the mounting beam 13, opposite to the first mounting element 113, where the mounting bracket 18 is configured to mount the portable resistance device 2. In the preferred embodiment of the present invention, the mounting bracket 18 may take the form of a quick detach fastening implement that readily attaches the portable resistance device 2 to the mounting beam 13.

Figure 3:
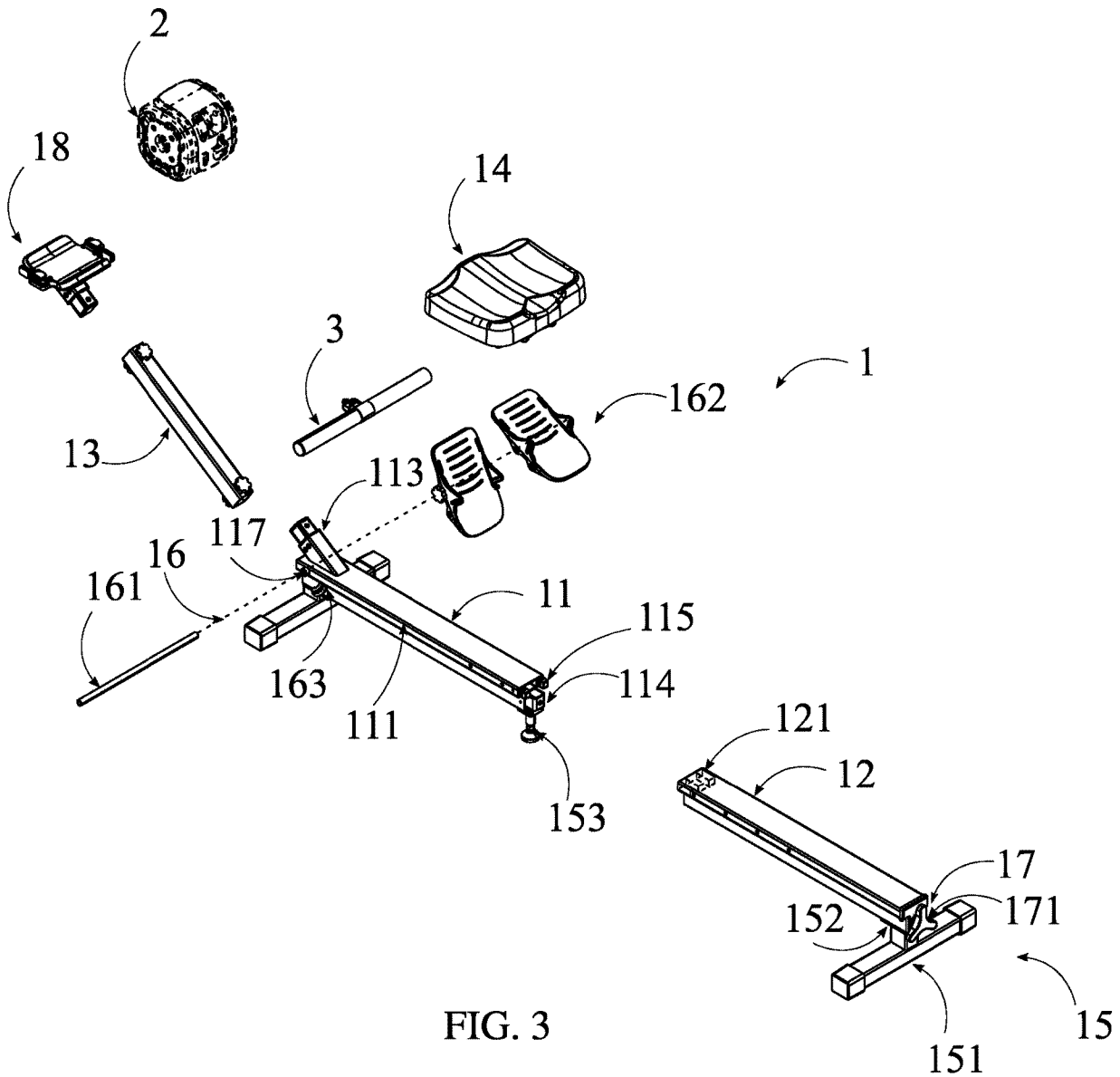
FIG. 3 is an exploded view of the present invention.
Figure 4:
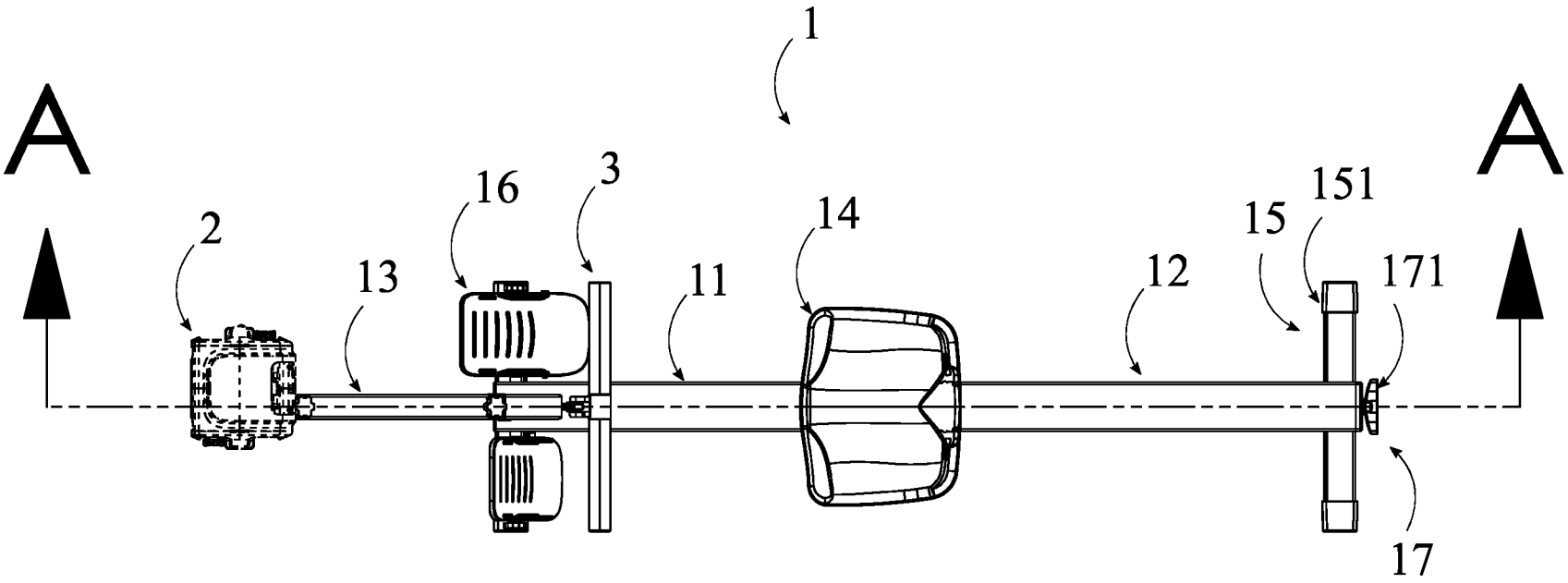
FIG. 4 is a top view of the present invention.
Figure 5:
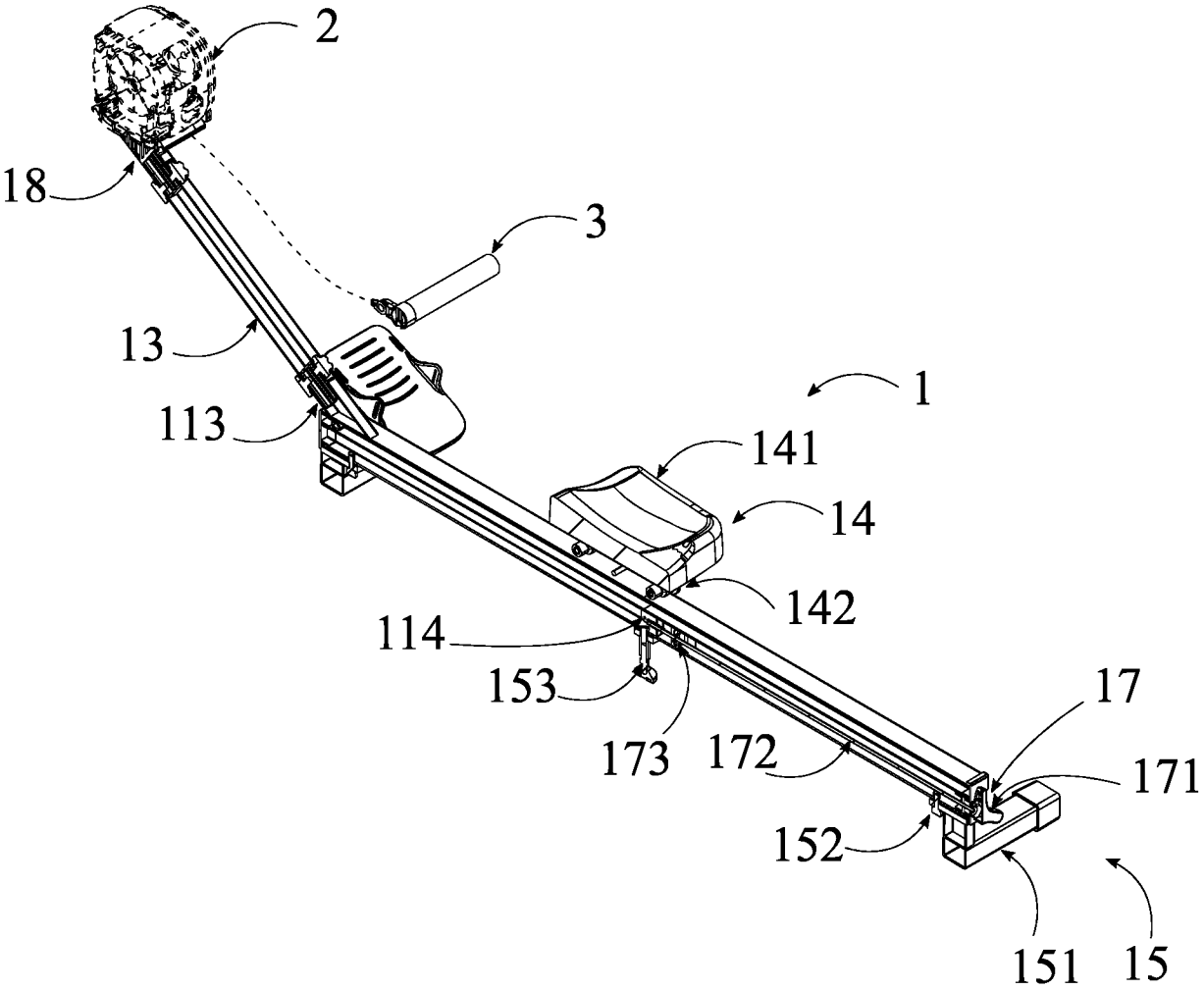
FIG. 5 is a section view of the present invention taken along cutting line A-A in FIG. 4.

In the preferred embodiment of the present invention, the front rowing beam 11 further comprises a second mounting element 114, as shown in FIGS. 3 and 5. In the preferred embodiment of the present invention, the connection element comprises a knob 171, a connection rod 172, and a rod bushing 173, as shown in FIG. 5. The second mounting element 132 is connected adjacent to the front rowing beam 11, opposite to the first mounting element 113. The rod bushing 173 is connected within the rear rowing beam 12. The connection rod 172 traverses through the rear rowing beam 12 and the rod bushing 173. The connection rod 172 is removably attached to the second mounting element 114. The knob 171 is connected adjacent to the connection rod 172, opposite to the second mounting element 114, where the knob 171 is configured to operatively engage the connection rod 172 to detach or attach the rear rowing beam 12 to the front rowing beam 11. In the preferred embodiment of the present invention, the connection element 17 allows the user to quickly and conveniently attach or detach the front rowing beam 11 from the rear rowing beam 12. The connection rod 172 may take the form of a threaded rod fastener that screws and secures into the corresponding second mounting element 114. The second mounting element 114 may take the form of a threaded receiving implement that facilitates the connection and alignment of the front rowing beam 11 to the rear rowing beam 12. In various embodiments, the connection element 17 may take the form of any other suitable fastening implement, such as, but not limited to breech locking fasteners, tensile detents, or any other suitable fastening implement.

In the preferred embodiment of the present invention, the front rowing beam 11 comprises a plurality of mounting dowels 115, as shown in FIG. 3. The rear rowing beam 12 comprises a plurality of mounting slots 121, as shown in FIG. 3. The plurality of mounting dowels 115 is connected adjacent to the front rowing beam 11, opposite to the first mounting element 113. The plurality of mounting slots 121 is connected adjacent to the rear rowing beam 12. Each of the plurality of mounting dowels 115 is connected to each of the plurality of mounting slots 121. In the preferred embodiment of the present invention, the plurality of mounting dowels 115 may take the form of connection implements that aid in aligning and reinforcing the connection between the front rowing beam 11 and the rear rowing beam 12.

In the preferred embodiment of the present invention, each of the at least one leg 15 comprises a base 151 and a connector 152, as shown in FIGS. 1-3 and 5. The base 151 is connected adjacent to the connector 152. The connector 152 is removably attached to the mounting channel 112. In the preferred embodiment of the present invention, the base 151 serves as the ground stabilizing implement of the at least one leg 15. In the preferred embodiment of the present invention, the base 151 may take the form of a horizontal beam that runs lateral from the front rowing beam 11 and the rear rowing beam 12. In various embodiments, the base 151 may take the form of any other suitable stabilizing implement. In the preferred embodiment of the present invention, the connector 152 may take the form of a quick detach fastening implement that secures along the mounting channel 112. The connector 152 may take the form of a spring actuated detent lock type connecting implement but may take the form of any other suitable connecting implement.

In the preferred embodiment of the present invention, each of the at least one leg 15 comprises an adjustment element 153, as shown in FIGS. 1-3 and 5. The adjustment element 153 is connected between the base 151 and the connector 152, where the adjustment element 153 is configured to adjust the leg 15 in length. In the preferred embodiment of the present invention, the rowing seat 14 comprises a cushion 141 and a shuttle 142. The shuttle 142 is connected adjacent to the cushion 141. The shuttle 142 is slidably engaged to the slider rail 111. In the preferred embodiment of the present invention, the cushion 141 may take the form of any suitable exercise machine cushion 141 that provides comfort. In the preferred embodiment of the present invention, the shuttle 142 may take the form of a roller style sliding mechanism, such that the shuttle 142 glides freely along the slider rail 111.

In the preferred embodiment of the present invention, the front rowing beam 11 further comprises a pedal aperture 117, as shown in FIG. 3. The pedal assembly 16 comprises a pedal axle 161, a pair of pedal inserts 162, and an adjustment mechanism 163, as shown in FIG. 3. The pedal aperture 117 is terminally positioned opposite to the rear rowing beam 12. The pedal aperture 117 traverses through the front rowing beam 11. The pedal axle 161 is axially connected to the pedal aperture 117. The pair of pedal inserts 162 is axially connected to the pedal axle 161. The adjustment mechanism 163 is operatively engaged to the pair of pedal inserts 162, where the adjustment mechanism 163 is configured to axially adjust the pair of pedal inserts 162 along the front rowing beam 11.

Figure 6:
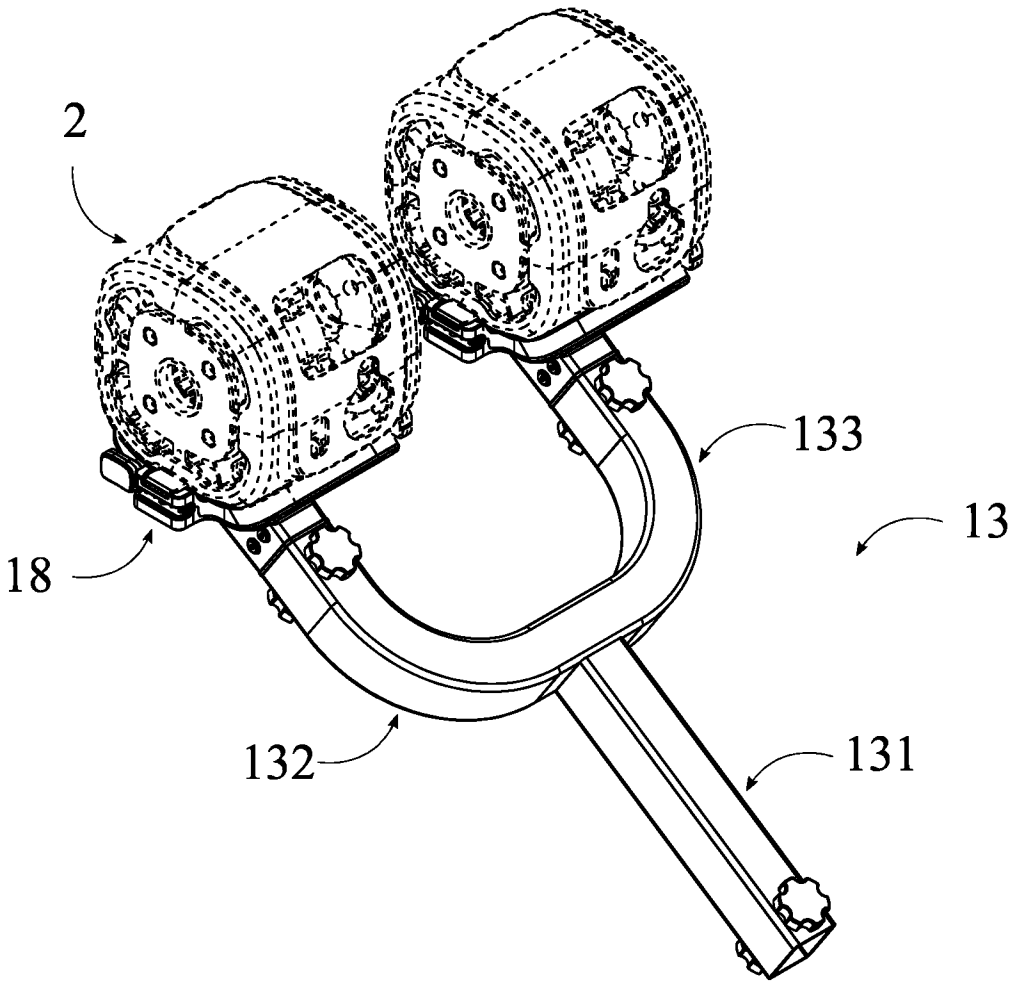
FIG. 6 is a top perspective view of a mounting beam used in the present invention, in accordance to another embodiment.

In another embodiment of the present invention, the mounting beam 13 comprises a first mounting bar 131, a second mounting bar 132, and a third mounting bar 133, as shown in FIG. 6. The first mounting bar 131 is removably attached to the first mounting element 113. The first mounting bar 131 is connected between the second mounting bar 132 and the third mounting bar 133, where the second mounting bar 132 and the third mounting bar 133 are configured to each mount a pair of portable resistance devices 2. In this embodiment, the mounting bar 13 is able to facilitate two portable resistance devices 2, allowing the user to perform rowing exercises with a two-point row paddle handle 3. In another embodiment of the present invention, the rowing frame 1 further comprises at least one mounting bracket 18. Each of the at least one mounting bracket 18 is removably attached to the second mounting bar 132 and the third mounting bar 133, where the each of the at least one mounting bracket 18 is configured to mount the pair of portable resistance devices 2.

Although the invention has been explained in relation to its preferred embodiment, it is to be understood that many other possible modifications and variations can be made without departing from the spirit and scope of the invention as hereinafter claimed.

What is claimed is:

1. A rowing frame comprising:

a front rowing beam;

a rear rowing beam;

a mounting beam;

a rowing seat;

at least one leg;

a pedal assembly;

the front rowing beam and the rear rowing beam each comprising a slider rail and a mounting channel;

the front rowing beam comprising a first mounting element;

the slider rail traversing from the front rowing beam to the rear rowing beam;

the mounting channel traversing from the front rowing beam to the rear rowing beam, opposite to the slider rail;

the rear rowing beam being removably attached to the front rowing beam through a connection element;

the first mounting element being positioned opposite to the rear rowing beam along the front rowing beam;

the mounting beam being removably attached to the first mounting element, wherein the mounting beam is configured to mount a portable resistance device;

the rowing seat being slidably attached to the slider rail;

at least one leg being distributed about the mounting channel; and the pedal assembly being connected adjacent to the front rowing beam, opposite to the rear rowing beam.

2. The rowing frame, as claimed in claim 1, comprising:

a mounting bracket; and the mounting bracket being removably attached adjacent to the mounting beam, opposite to the first mounting element, wherein the mounting bracket is configured to mount the portable resistance device.

3. The rowing frame, as claimed in claim 1, comprising:

the front rowing beam comprising a second mounting element;

the connection element comprising a knob, a connection rod, and a rod bushing;

the second mounting element being connected adjacent to the front rowing beam, opposite to the first mounting element;

the rod bushing being connected within the rear rowing beam;

the connection rod traversing through the rear rowing beam and the rod bushing;

the connection rod being removably attached to the second mounting element; and the knob being connected adjacent to the connection rod, opposite to the second mounting element, wherein the knob is configured to operatively engage the connection rod to detach or attach the rear rowing beam to the front rowing beam.

4. The rowing frame, as claimed in claim 1, comprising:

the front rowing beam comprising a plurality of mounting dowels;

the rear rowing beam comprising a plurality of mounting slots;

the plurality of mounting dowels being connected adjacent to the front rowing beam, opposite to the first mounting element; and the plurality of mounting slots being connected adjacent to the rear rowing beam; and each of the plurality of mounting dowels being connected to each of the plurality of mounting slots.

5. The rowing frame, as claimed in claim 1, comprising:

each of the at least one leg comprising a base and a connector;

the base being connected adjacent to the connector; and the connector being removably attached to the mounting channel.

6. The rowing frame, as claimed in claim 5, comprising:

each of the at least one leg comprising an adjustment element; and the adjustment element being connected between the base and the connector, wherein the adjustment element is configured to adjust the leg in length.

7. The rowing frame, as claimed in claim 1, comprising:

the rowing seat comprising a cushion and a shuttle;

the shuttle being connected adjacent to the cushion; and the shuttle being slidably engaged to the slider rail.

8. The rowing frame, as claimed in claim 1, comprising:

the front rowing beam comprising a pedal aperture;

the pedal assembly comprising a pedal axle, a pair of pedal inserts, and an adjustment mechanism;

the pedal aperture being terminally positioned opposite to the rear rowing beam;

the pedal aperture traversing through the front rowing beam;

the pedal axle being axially connected to the pedal aperture;

the pair of pedal inserts being axially connected to the pedal axle; and the adjustment mechanism being operatively engaged to the pair of pedal inserts, wherein the adjustment mechanism is configured to axially adjust the pair of pedal inserts along the front rowing beam.

9. The rowing frame, as claimed in claim 1, comprising:

the mounting beam comprising a first mounting bar, a second mounting bar, and a third mounting bar;

the first mounting bar being removably attached to the first mounting element;

the first mounting bar being connected between the second mounting bar and the third mounting bar, wherein the second mounting bar and the third mounting bar are configured to each mount a pair of portable resistance devices.

10. The rowing frame, as claimed in claim 9, comprising:

at least one mounting bracket; and each of the at least one mounting bracket being removably attached to the second mounting bar and the third mounting bar, wherein the each of the at least one mounting bracket is configured to mount the pair of portable resistance devices.

* * * * *